United States Patent [19]

Langen et al.

[11] Patent Number: 4,683,619

[45] Date of Patent: Aug. 4, 1987

[54] APPARATUS FOR CAN CHANGING

[75] Inventors: Manfred Langen; Konrad Temburg; Paul Teichmann, all of Mönchengladbach, Fed. Rep. of Germany

[73] Assignee: Trützschler GmbH & Co. KG, Mönchengladbach, Fed. Rep. of Germany

[21] Appl. No.: 905,263

[22] Filed: Sep. 9, 1986

[30] Foreign Application Priority Data

Sep. 10, 1985 [DE] Fed. Rep. of Germany ..... 3532173
Jun. 26, 1986 [DE] Fed. Rep. of Germany ..... 3621370

[51] Int. Cl.[4] ..... D01H 9/18; B65H 67/06
[52] U.S. Cl. ..... 19/159 A
[58] Field of Search ..... 19/159 A

[56] References Cited

U.S. PATENT DOCUMENTS 3,808,641 5/1974 Schneider ..... 19/159 A
4,012,893 3/1977 Weber ..... 19/159 A
4,059,185 11/1977 Weber ..... 19/159 A

*Primary Examiner*—Louis K. Rimrodt
*Attorney, Agent, or Firm*—Spencer & Frank

[57] ABSTRACT

An apparatus for transporting at least one can between a sliver furnishing fiber processing machine, e.g. a carding machine, and a sliver fed fiber processing machine, e.g. a drawing frame, by means of a transporting carriage. In order to improve loading and unloading as well as transport of the spinning cans, a loading and unloading device for the can is associated with the transporting carriage, with the loading and unloading device including conveyor elements for moving the can with respect to the transporting carriage.

22 Claims, 18 Drawing Figures

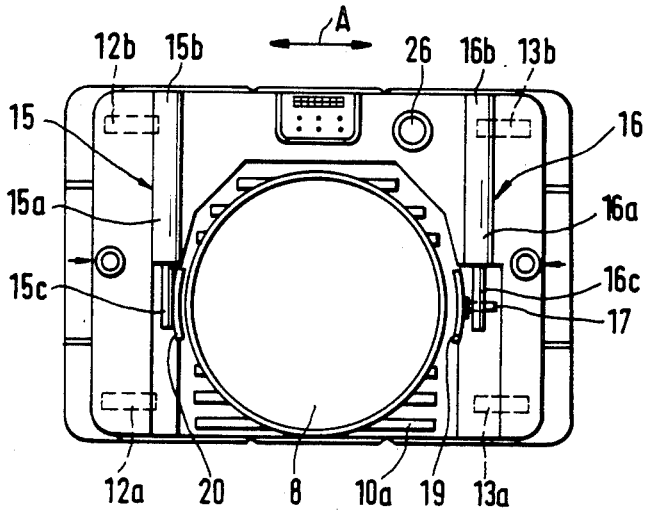
FIG. 3
FIG. 4
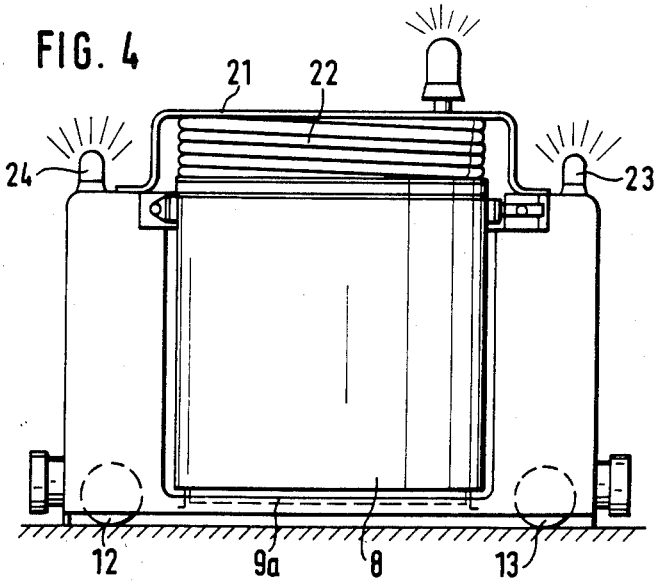

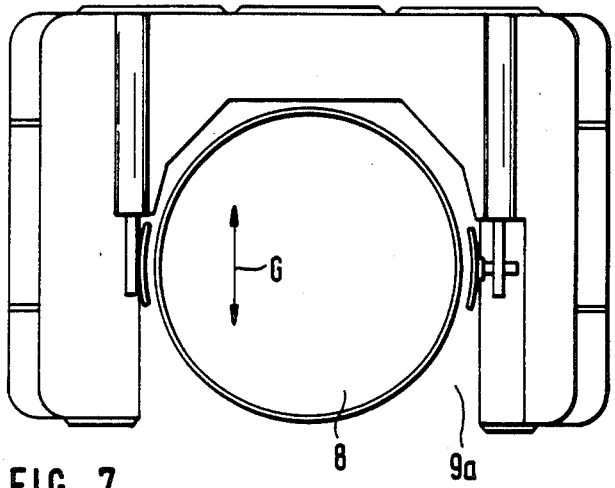
FIG. 7
FIG. 8
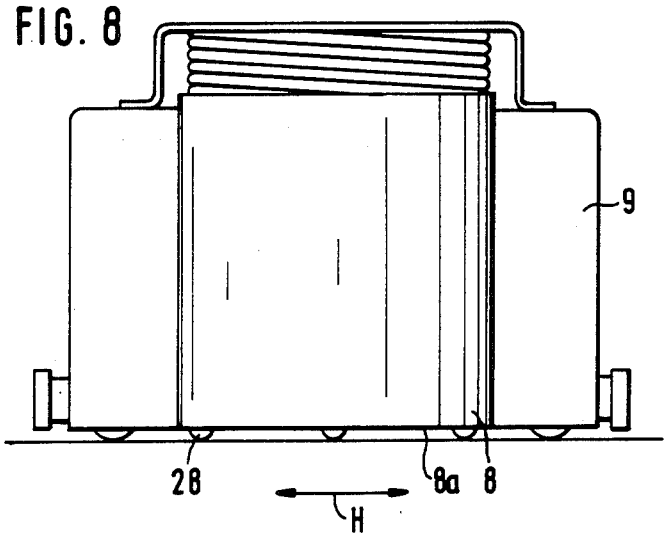

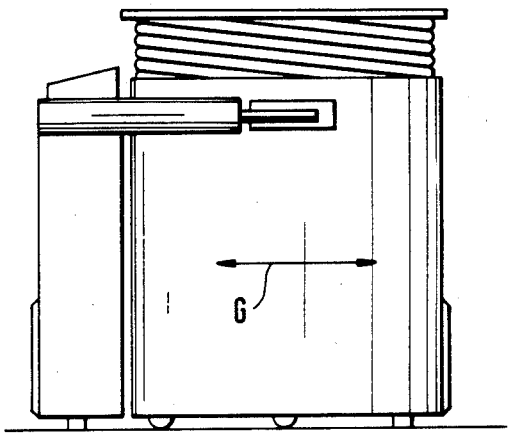
FIG. 9
FIG. 10
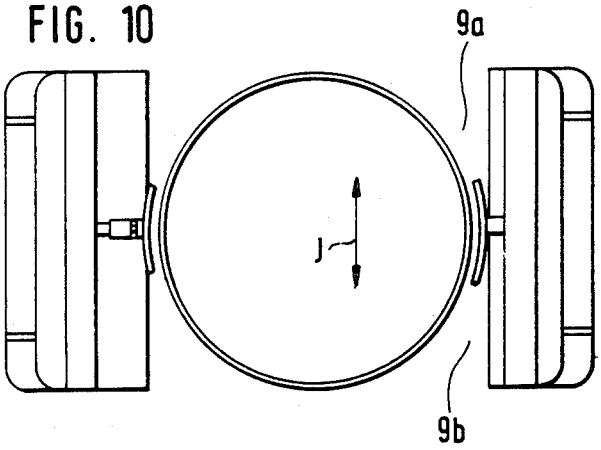

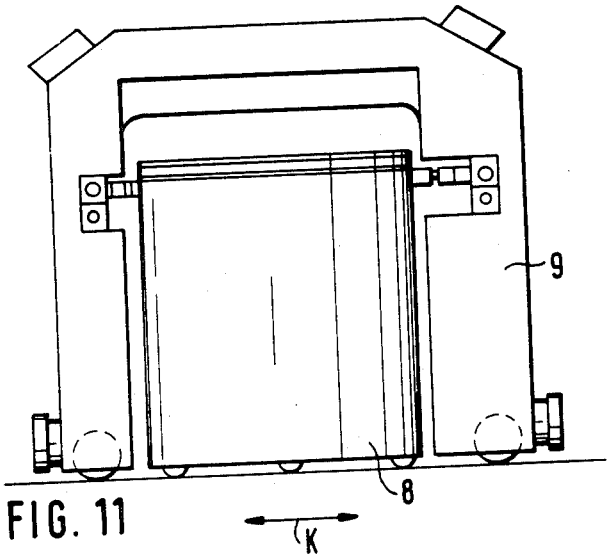
FIG. 11
FIG. 11a
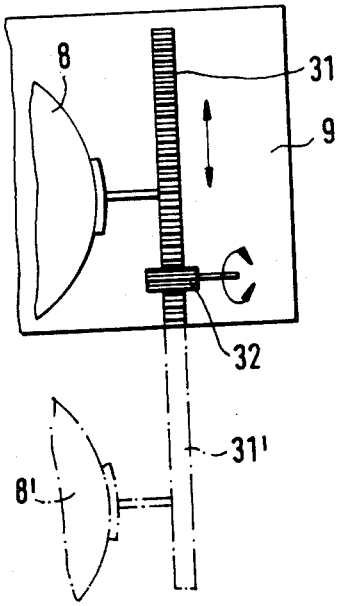
FIG. 12
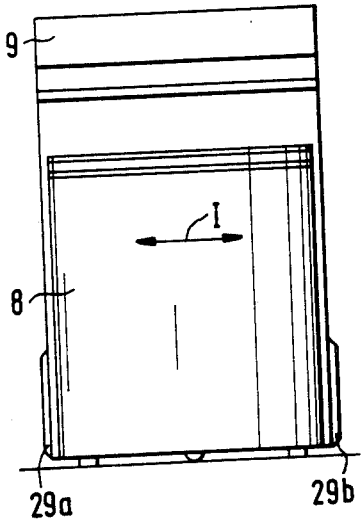

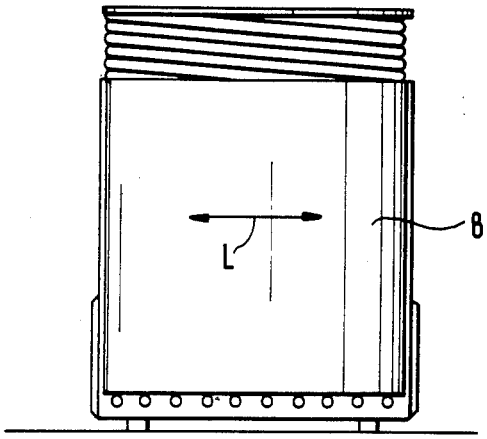
FIG. 15
FIG. 16
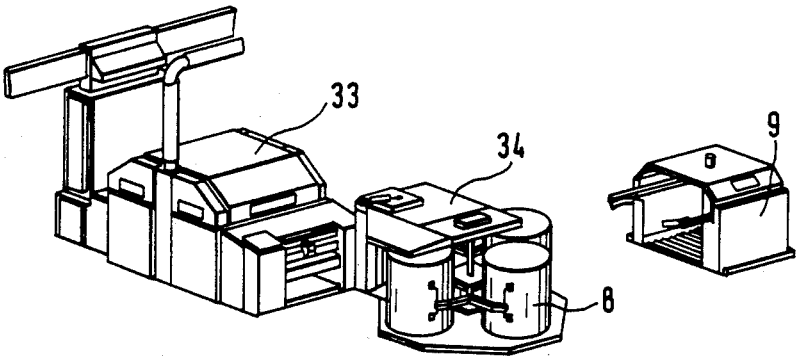

APPARATUS FOR CAN CHANGING

BACKGROUND OF THE INVENTION

The present invention relates to an apparatus for transporting at least one can between a sliver furnishing fiber processing machine, e.g. a carding machine, and a sliver fed fiber processing machine, e.g. a drawing frame, by means of a transporting carriage.

The control mechanism of the copending U.S. application entitled "Apparatus For Automatically Transporting A Can Between A Sliver Furnishing And A Sliver Fed Spinning Industry Machine" filed on or about the same day as the present invention and based on Foreign Application No. FRG No. P 35 32 173.3 filed Sept. 10th, 1985 and FRG No. P 36 21 370.5 filed June 26th, 1986, may be used for controlling the present transporting carriage and is incorporated herein by reference.

In a known device, two handles are disposed on opposite sides of a spinning can to push the can onto the carriage. Such a device is disclosed in German Pat. No. 1,685,629. Then the carriage is manually pushed from the carding machine to the drawing frames. This makes the machine dependent on personnel, i.e. it is not possible to reliably displace the spinning cans and the transporting carriage with this known device. There is the additional drawback that loading and unloading of the cans and their transport cannot be performed with a single device.

SUMMARY OF THE INVENTION

It is therefore an object of the present invention to provide an apparatus of the above-mentioned type which avoids the stated drawbacks and which, in particular, permits loading and unloading as well as transporting of the spinning cans in a simple and reliable manner.

The objects of the invention are realized by the present invention which discloses an apparatus for transporting at least one can between a sliver furnishing fiber processing machine and a sliver fed fiber processing machine. The apparatus comprises a transporting carriage and a device associated with the carriage for loading and unloading the at least one can. The device includes a conveying element for moving the at least one can with respect to the transporting carriage.

Preferably, the loading and unloading device is able to accommodate the can within the transporting carriage between the wheels of the carriage. In this way, the can is supported in or near its center of gravity so that high stability of the can position is realized during transport. Moreover, switching of carriages is also facilitated when the can is supported near its center of gravity.

Advisably, the loading and unloading device is a gripper which is able to grip the can. The gripper is rotatable about a horizontal axis and is attached to the transporting carriage. The gripper has at least one pneumatic cylinder with which the can may be pushed or pulled. Preferably, a telescoping cylinder is provided which includes a pressure cylinder and which has a plurality of cylinder pistons to realize a wide range for the gripper. Advantageously, the transporting carriage includes a roller conveyor which is driven and which facilitates displacement of the can. The roller conveyor of the transporting carriage is disposed opposite a stationary pickup station at the carding machine or at the reserve station near the drawing frame. Advantageously, the cans slide on the level floor of the transporting carriage. A retainer for a filled can is provided above the can which presses on sliver material projecting beyond the edge of the can. The retainer may be a lid, a covering sheet, bar or the like and is advisably fastened to the transporting carriage so that only one retainer is required for a plurality of cans. The retainer prevents the sliver material from slipping during transport. The retainer is adjustable in height so it can be adapted to different fill levels in the cans. The retainer may be a conveyor belt which rotates at the speed at which the can is loaded or unloaded.

According to a preferred embodiment, a driving device, e.g. an electric motor, is provided to drive the transporting carriage. This avoids the need for costly and cumbersome manual pushing of the carriage. The transporting carriage may also move automatically on a horizontal path.

The present invention will be described in greater detail below with reference to embodiments that are illustrated in the drawings.

BRIEF DESCRIPTION OF THE DRAWINGS

FIG. 3 is a plan view of the can transporting device of FIG. 2 including a gripper and a can disposed in the transporting carriage.

FIG. 4 is a side view of the can transporting device according to FIG. 2.

FIG. 7 is a top plan view in which the can is transported in direction G.

FIG. 8 shows an embodiment of the can transporting device similar to FIG. 4 in which the can is transported on rollers at ground level.

FIG. 9 is a front view of the can transporting device in which the can is transported in the direction of G.

FIGS. 10, 11 and 12 show an embodiment of the transporting device in which a two-sided loading and unloading station is included.

FIG. 11*a* is an enlarged view of the toothed rod and pinion connection of FIG. 14.

FIGS. 13 to 15 show a can transporting device including a toothed rod displacement device.

FIG. 16 is a perspective view of the transporting device, the carding machine and the can changer according to the present invention.

DETAILED DESCRIPTION OF THE INVENTION

Figure 1:
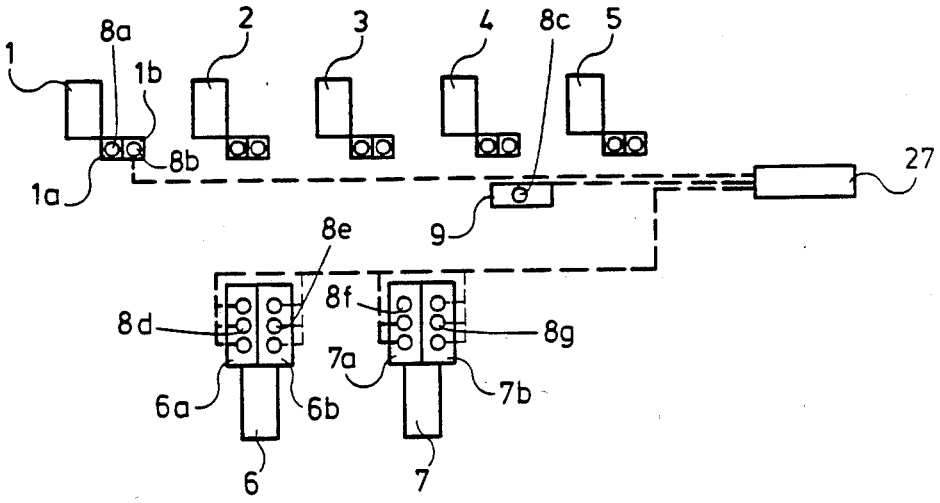
FIG. 1 is a schematic plan view of a spinning preparation device including five carding machines and two drawing frames and employing the can transporting device according to the invention.

The spinning preparation device shown in FIG. 1 includes five carding machines 1 to 5 and two drawing frames 6 and 7, which are shown schematically. Each carding machine 1 to 5 has an associated feeding device 1*a* for feeding the slivers into a spinning can 8*a*. In addition to feeding device 1*a*, there is also provided a pickup station 1*b* where the spinning cans 8*b* filled with card sliver can be deposited. Feeding device 1*a* and pickup station 1*b* may be part of a known can changing device. To transport can 8*c* between carding machines 1 to 5 and drawing frames 6 and 7, a transporting carriage 9 is provided which transports can 8*c* to reserve station 6*a* of drawing frame 6 or to reserve station 7*a* of drawing frame 7. The six spinning cans (reserve position) marked 8*d* and 8*f*, respectively, are disposed at the same level as six further filled spinning cans 8*e* and 8*g*, respectively. Spinning cans 8*e* and 8*g* are disposed at the inlet of drawing frames 6 and 7, respectively, where the carding machine slivers are removed from them and are fed to the drawing mechanisms of drawing frames 6 and 7, respectively, for multiple filament production and decoration. It is understood that instead of two spinning cans 8*e* and 8*g*, a larger or smaller number of spinning cans can be placed simultaneously at the inlet of drawing frames 6 and or 7 if a different type of multifilament design is desired. The reference numeral 27 identifies a reserve station (buffer) for spinning can 8 which is disposed between the carding machine and the drawing frame and is able to accommodate full and/or empty cans, as required. The traveling path of transporting carriage 9 is shown in dashed lines.

Figure 2:
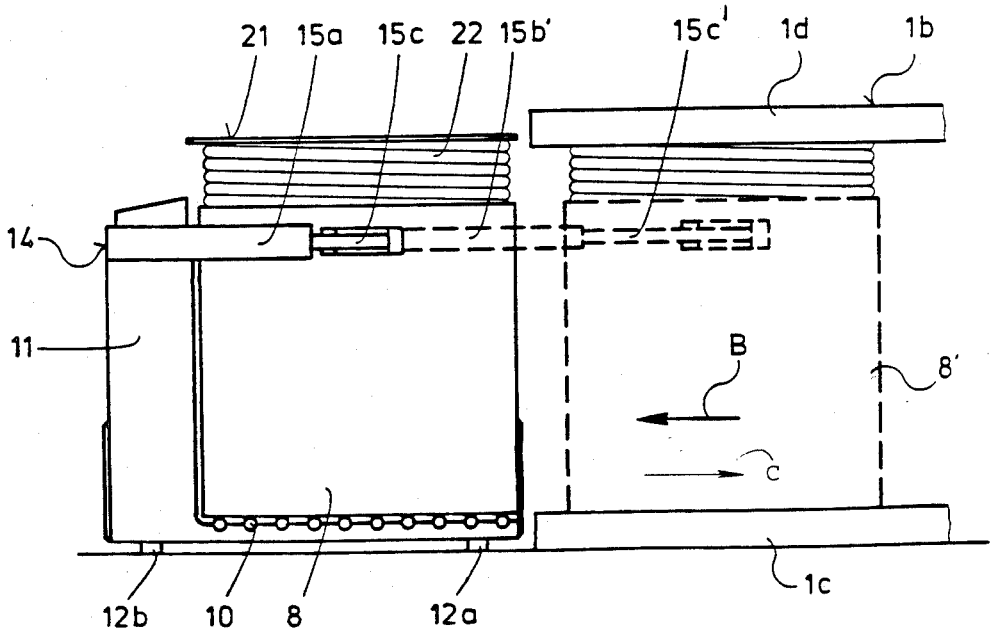
FIG. 2 is a front view of the can transporting device with roller conveyor and telescoping cylinder next to a can changer (shown only in part) for a carding machine.

FIGS. 2 and 3 show the transporting carriage 9 for each can 8 having a diameter of, for example 1000 mm. The can 8 to be exchanged stands on a roller conveyor 10 whose height above the level floor is, for example, 120 mm. The chassis 11 includes the drives, e.g. an electric motor 26 (see FIG. 3) to drive the carriage, the drives (not shown) for the telescoping cylinders 15 *a,b,c* and 16 *a,b,c* (see FIG. 3), energy supply devices and the like. The chassis 11 moves on steered axles 12 and 13 equipped with four wheels 12*a*, 12*b*, 13*a*, 13*b*, in the direction indicated by arrow A (see FIG. 3). Can 8 is accommodated within transporting carriage 9 between its wheels 12*a*, 12*b* and 13*a*, 13*b* (see FIG. 3).

A gripper 14 is attached to chassis 11 of transporting carriage 9 as the loading and unloading device for can 8. Gripper 14 has two horizontal telescoping cylinders 15 and 16 which are each composed of cylinder pistons 15*a*, 15*b* and 15*c* and 16*a*, 16*b* and 16*c*, respectively. At the end of cylinder piston 16*b*, a pressure cylinder 17 is provided (see FIG. 3), at an angle of 90°, to act in the radial direction of can 8 and clamp can 8 against pressure cylinder 15. For adaptation to the circular surface of can 8, bent clamping pieces 19 and 20 are provided.

Above can 8 (see FIG. 2), a retainer 21 is provided for the material 22 filling the can, e.g. the sliver. Referring to FIG. 4, retainer 21 is fastened to chassis 11. Also provided at chassis 11 are blinking warning lights 23, 24 which are activated when transporting carriage 9 is displaced along the traveling path.

According to FIG. 2, transporting carriage 9 is positioned with its longitudinal side next to pickup station 1*b* of a (schematically shown) can exchanger for a carding machine. Between bottom plate 1*c* and cover plate 1*d*, can 8' is shown in dashed lines in the pickup position. Then cylinder pistons 15*b*, 15*c* and 16*b*, 16*c* (see FIG. 3) move into positions 15*b'* and 15*c'* shown in dashed lines or, respectively, into positions 16*b'* and 16*c'* (not shown). The cylinder pistons move out simultaneously and then pressure cylinder 17 is actuated so that clamping pieces 19 and 20 take can 8' between them in the manner of a vise. This causes pressure cylinder 17 to clamp can 8' perpendicularly to telescoping cylinders 15 and 16. Then cylinder pistons 15*b'* and 15*c'* and 16*b'* and 16*c'* are again pulled into cylinder pistons 15*a* and 16*a*, respectively. This causes can 8 to be pulled in the direction of arrow B (see FIG. 2) from position 8' into position 8 on the roller conveyor 10 of transporting carriage 9.

Transporting carriage 9 then moves to one of drawing frames 6 or 7. Can 8 is deposited from transporting carriage 9 in the reserve station 6*a* or 7*a* of drawing frames 6 or 7, respectively, by actuation of gripper 14 in the reverse sense.

Transporting carriage 9 is able to transport empty cans 8 back from drawing frame 6 or 7 to one of the carding machines 1 to 5 or to a reserve station at the carding machines, for example a can changer. For this purpose, the empty can 8 is pushed in the direction of arrow C (see FIG. 2) from roller conveyor 10 to the reserve station at the carding machine or into the can changer (see FIG. 3).

According to FIG. 3, the transporting carriage moves according to the orientation of its wheels 12*a*, 12*b*, 13*a*, 13*b* in the direction of arrow A.

Figure 5:
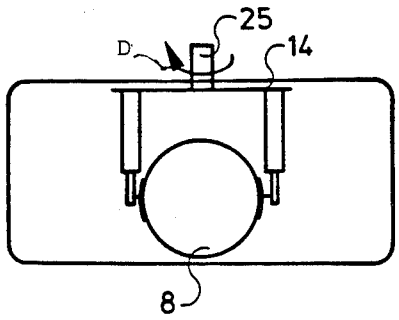
FIG. 5 shows a top plan view of the transporting device as in FIG. 2 in which the gripper is rotatable about a horizontal axis.

According to FIG. 5, gripper 14 is rotatable about a horizontal axis 25 (see arrow D) so that can 8 can be moved from a vertical position into some other position.

Figure 6A:
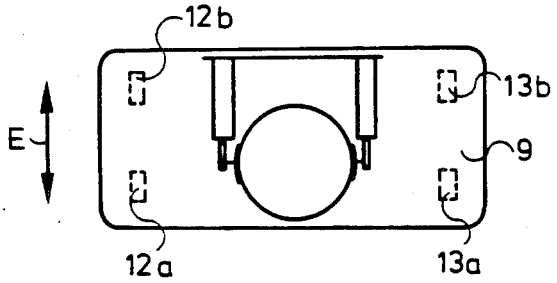
FIG. 6*a* is a top plan view similar to FIG. 3 but with the can being transported in the direction of arrow E.
Figure 6B:
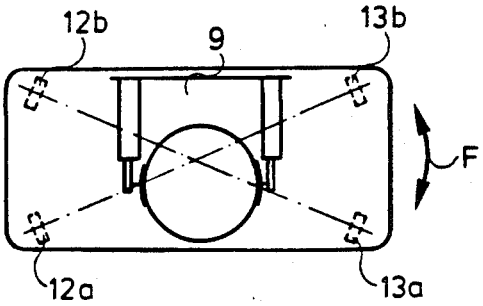
FIG. 6*b* is a top plan view similar to FIG. 3 but with the can being transported in the direction of arrow F.

According to FIG. 6*a*, wheels 12*a*, 12*b*, 13*a*, 13*b* are changed in position by 90° in comparison to the wheels of FIG. 3 about a perpendicular axis by a changing device (not shown) so that transporting carriage 9 moves in the direction of arrow E. According to FIG. 6*b*, wheels 12*a*, 12*b*, 13*a*, 13*b* are rotated in such a manner that their horizontal wheel axes intersect at a certain point so that transporting carriage 9 performs a rotary movement, in place, in the direction of arrow F.

FIGS. 7 to 9 show an embodiment in which rollers 28 (see FIG. 8) are disposed in the bottom 8*a* of can 8, and rollers 28*b* are disposed on the bottom of transporting carriage 9, with rollers 28, 28*b* rolling directly on the floor of the fiber processing plant. In FIGS. 7 and 9, arrow G indicates the direction of the loading and unloading device of can 8. In FIG. 7, the transporting carriage 9 has a one-sided loading and unloading opening 9*a* for can 8. In FIG. 8, arrow H shows the direction of travel of transporting carriage 9 with can 8.

FIGS. 10, 11 and 12 show an embodiment in which a two-sided loading and unloading station is provided for the can. In FIG. 10, the transporting carriage has a two-sided loading and unloading opening 9*a*, 9*b* for the can. Can 8 can thus be moved in the direction of arrow I (FIG. 12) and arrow J (FIG. 10) into or out of transporting carriage 9 from two sides. In FIG. 11, arrow K indicates the direction of travel of transporting carriage 9 with can 8. According to FIG. 12, two safety contact plates 29*a*, 29*b* are provided on the sides of the lower end of transporting carriage 9.

Figure 13:
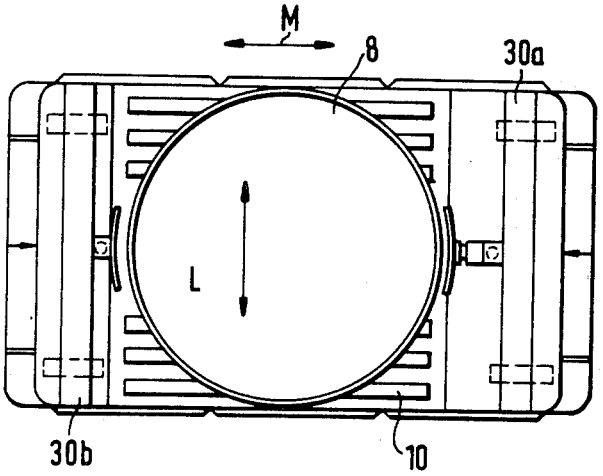
Figure 14:
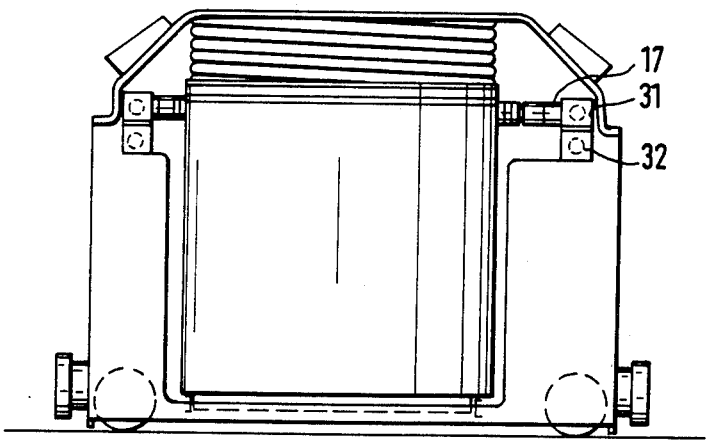

FIG. 13 shows a transporting carriage 9 with roller conveyor 10 which permits two-sided loading and unloading of can 8 according to arrow L. Arrow M shows the direction of travel of transporting carriage 9. The conveying elements for the movement of can 8 with respect to transporting carriage 9 are two toothed rod displacement devices 30*a*, 30*b*. According to FIG. 14, pressure cylinder 17 is fastened to a toothed rod 31 which meshes with a stationary, driven pinion 32. FIG. 11*a* shows an enlarged drawing of toothed rod 31 which moves in direction N as stationary pinion 32 moves about axis 33. Dotted lines 17', 31' and 8' show pressure cylinder 17' in an extended position. In FIG. 15, arrow L indicates the direction of the loading and unloading station of can 8.

FIG. 16 is a perspective view of transporting carriage 9 in the vicinity of a carding machine 33 and a can changer 34.

According to the invention, an automatically controlled transporting carriage 9 is provided for at least one can 8. Transporting carriage 9 includes a loading and unloading device with which empty or full cans can be loaded and unloaded. The loading and unloading device grips can 8 and pulls it onto transporting carriage 9 or pushes it in front of transporting carriage 9. The loading and unloading of transporting carriage 9 occurs in at least one direction, after the can 8 to be exchanged has been automatically actuated and gripped.

The present invention is described for the example of a carding machine as the sliver delivering fiber processing machine and a drawing frame as the sliver fed fiber processing machine. The invention can be utilized in a similar manner, for example, for a drawing frame or a flyer as the sliver delivery fiber processing machine and a flyer or a spinning machine as the sliver fed fiber processing machine and includes such machines.

Preferably the electric motor 26 (drive motor) of FIG. 3 is connected by wire, for example by way of a current collector, flexible lines and the like, to an energy source. According to a further suitable embodiment, the electric motor is connected to a battery which is fastened to the transporting carriage 9.

Electric motor 26 drives wheels 12*a*, 12*b*, 13*a*, 13*b* of carriage 9, e.g. by a known power transmission. Gripper 14 and cylinders 15 and 16 are controlled to move into the broken-line positions of FIG. 2 by a control unit, which may be electrically connected with a central control (computer). The cylinders 15, 16 and 17 are activated by a known activating unit.

The present disclosure relates to the subject matter disclosed in FRG Application No. P 35 32 173.3 filed Sept. 10th, 1985, and FRG Application No. P 36 21 370.5 filed June 26th, 1986, the entire specification of which is incorporated herein by reference.

It will be understood that the above description of the present invention is susceptible to various modifications, changes and adaptations, and the same are intended to be comprehended within the meaning and range of equivalents of the appended claims.

We claim:

1. An apparatus for transporting at least one can between a sliver furnishing fiber processing machine and a sliver fed fiber processing machine, comprising: a transporting carriage and a device mounted on said carriage for loading and unloading the at least one can; said loading and unloading device including a conveying element for moving the at least one can with respect to said transporting carriage.

2. Apparatus as defined in claim 1, wherein said carriage comprises a plurality of wheels and is able to accommodate the at least one can between its wheels.

3. Apparatus as defined in claim 2, wherein the wheels of said transporting carriage are adjustable about a perpendicular axis for changing the direction of travel.

4. Apparatus as defined in claim 1, wherein said conveying elements comprise at least one pneumatic telescoping cylinder.

5. Apparatus as defined in claim 4, wherein said pneumatic telescoping cylinder includes a pressure cylinder.

6. Apparatus as defined in claim 1, wherein said loading and unloading device comprises a gripper operable for gripping the at least one can.

7. Apparatus as defined in claim 6, wherein said gripper is attached to said transporting carriage.

8. Apparatus as defined in claim 6, wherein said gripper is rotatable about a horizontal axis.

9. Apparatus as defined in claim 1, wherein said conveying element comprises at least one toothed rod displacement device.

10. Apparatus as defined in claim 1, wherein said transporting carriage includes a roller conveyor.

11. Apparatus as defined in claim 10, wherein the rollers of said roller conveyor are driven.

12. Apparatus as defined in claim 10, wherein the sliver furnishing machine contains a stationary pickup station, the sliver fed machine contains a reserve station, and said transporting carriage contains a loading and unloading opening, the loading and unloading opening being disposed opposite said reserve station and the roller conveyor being disposed opposite said stationary pickup station.

13. Apparatus as defined in claim 1, wherein said transporting carriage contains a level floor on which the at least one can slides.

14. Apparatus as defined in claim 13, wherein said level floor contains rollers which allow said transporting carriage to roll.

15. Apparatus as defined in claim 1, wherein said transporting carriage has a one-sided loading and unloading opening for the at least one can.

16. Apparatus as defined in claim 1, wherein said transporting carriage has a two-sided loading and unloading opening for the at least one can.

17. Apparatus as defined in claim 1, further comprising a retainer disposed above the at least one can for preventing material within the can from slipping.

18. Apparatus as defined in claim 17, wherein said retainer is adjustable in height.

19. Apparatus as defined in claim 17, wherein said retainer comprises a conveyor belt which rotates at the loading and unloading speed of the at least one can.

20. Apparatus as defined in claim 1, wherein said transporting carriage is driven by a driving device.

21. Apparatus as defined in claim 20, further comprising an energy source, and wherein said driving device is an electric motor which is connected to said energy source.

22. Apparatus as defined in claim 21, wherein said energy source is a battery which is fastened to said transporting carriage and which is connected to said electric motor by one of wires, current collectors and flexible lines.

* * * * *